US011000109B2

(12) United States Patent
Ullmann

(10) Patent No.: US 11,000,109 B2
(45) Date of Patent: May 11, 2021

(54) DEVICE FOR CARRYING SHOULDER BAGS

(71) Applicant: THE POINT OF HEALTH, INC., New York, NY (US)

(72) Inventor: Kathleen T. Ullmann, New York, NY (US)

(73) Assignee: THE POINT OF HEALTH, INC., New York, NY (US)

( * ) Notice: Subject to any disclaimer, the term of this patent is extended or adjusted under 35 U.S.C. 154(b) by 0 days.

(21) Appl. No.: 16/762,850

(22) PCT Filed: Feb. 18, 2020

(86) PCT No.: PCT/US2020/018688
§ 371 (c)(1),
(2) Date: May 8, 2020

(87) PCT Pub. No.: WO2020/172193
PCT Pub. Date: Aug. 27, 2020

(65) Prior Publication Data

US 2020/0397124 A1 Dec. 24, 2020

Related U.S. Application Data

(60) Provisional application No. 62/808,810, filed on Feb. 21, 2019.

(51) Int. Cl.
*A45F 3/14* (2006.01)
*A45F 3/12* (2006.01)
(Continued)

(52) U.S. Cl.
CPC ..... *A45F 3/14* (2013.01); *A45F 3/12* (2013.01); *A45C 13/30* (2013.01); *A45F 5/00* (2013.01); *A45F 2003/142* (2013.01)

(58) Field of Classification Search
CPC ..... A45F 3/14; A45F 3/12; A45F 5/00; A45C 13/30; A45C 13/38
(Continued)

(56) References Cited

U.S. PATENT DOCUMENTS 211,460 A * 1/1879 Corn ..... A45F 3/15 224/266
460,392 A * 9/1891 Kalbach ..... A45F 5/00 224/265
(Continued)

FOREIGN PATENT DOCUMENTS

GB 2334669 1/1999

OTHER PUBLICATIONS

ISR and Written Opinion by ISA/US for PCT/US2020/018688.

*Primary Examiner* — Nathan J Newhouse
*Assistant Examiner* — Lester L Vanterpool
(74) *Attorney, Agent, or Firm* — Koffsky Schwalb LLC; Mark I. Koffsky

(57) ABSTRACT

A device that is a lightweight, small, easily packable, hands-free accessory that improves how people carry shoulder bags is described. The device is a mechanism worn on the user's upper back that leaves the individual's hands free and enhances the ease of carrying shoulder bags. The device can be worn on bare shoulders, clothing and outerwear. The device helps to equalize the weight distribution of shoulder bags across the top of the trapezius muscle and allows for a less cumbersome commute via foot and public transportation.

14 Claims, 4 Drawing Sheets

(51) Int. Cl.
*A45C 13/30* (2006.01)
*A45F 5/00* (2006.01)
*A45C 3/14* (2006.01)

(58) Field of Classification Search
USPC ..... 224/257, 260, 264, 266
See application file for complete search history.

(56) References Cited

U.S. PATENT DOCUMENTS 715,051 A * 12/1902 Derenaucourt ..... A43B 5/0425 294/148
741,098 A * 10/1903 Bibler ..... A45C 13/38 224/260
915,628 A * 3/1909 Seymore ..... A45F 3/14 224/260
966,562 A * 8/1910 Knoerzer ..... A45F 3/15 224/266
1,185,698 A * 6/1916 Miller ..... A45F 3/14 224/260
1,273,201 A * 7/1918 Teuber ..... A45F 5/02 224/182
1,281,822 A * 10/1918 Orr ..... 224/604
1,340,076 A * 5/1920 Orr ..... A45C 13/38 224/201
1,631,694 A * 6/1927 Rick ..... A45F 3/12 224/264
1,727,873 A * 9/1929 Farmer, Jr. ..... A45F 3/14 224/260
2,602,575 A * 7/1952 Olson ..... A45F 3/12 224/201
2,633,573 A * 4/1953 Sanders ..... A41F 15/007 2/460
2,651,441 A * 9/1953 Rau ..... A45F 3/14 224/259
2,718,988 A * 9/1955 Potts ..... A45F 5/00 224/609
2,808,973 A * 10/1957 Gobble ..... A45F 3/12 224/264
2,986,314 A * 5/1961 Miller ..... A45F 3/14 224/266
3,682,358 A * 8/1972 Richey ..... A45C 13/38 224/201
3,799,413 A * 3/1974 McBain ..... A45F 3/12 224/264
4,091,974 A * 5/1978 McClintock ..... A45F 5/00 224/257
5,370,286 A * 12/1994 Newman ..... A45F 3/14 119/857
5,388,743 A * 2/1995 Silagy ..... A45F 3/12 2/268
5,435,025 A * 7/1995 Gerard ..... A45C 3/10 5/417
5,667,266 A * 9/1997 Giocanti ..... A45F 5/1026 294/159
5,765,735 A * 6/1998 Kimchi ..... A45F 3/12 224/264
5,894,972 A * 4/1999 Brown ..... B65G 7/12 224/267
6,045,019 A * 4/2000 Moses ..... A45F 3/14 224/257
D441,651 S * 5/2001 Nygren ..... D9/434
D457,725 S * 5/2002 Parsons ..... D3/327
6,446,849 B1 * 9/2002 Schleifer ..... A43B 5/0425 224/258
6,499,781 B1 * 12/2002 Flynn ..... A45F 3/10 294/159
D469,355 S * 1/2003 Granadoz ..... D9/455
6,647,656 B2 * 11/2003 Mazzagetti ..... F41C 33/002 224/150
6,651,941 B1 * 11/2003 Kinsel ..... A45F 5/1026 248/100
6,652,431 B1 * 11/2003 Mattox ..... A63B 21/0004 224/201
D508,323 S * 8/2005 Douglas ..... D3/328
7,004,363 B2 * 2/2006 Fenton ..... A45F 3/12 224/264
7,377,568 B2 * 5/2008 Moses ..... A45F 5/1026 224/257
7,681,766 B2 * 3/2010 Harrison, III ..... A45F 3/10 224/265
8,225,971 B2 * 7/2012 Stark ..... A45C 13/38 224/257
10,278,483 B2 * 5/2019 Moore ..... A45F 5/102
2002/0030073 A1 * 3/2002 Duval ..... A45F 3/15 224/266
2004/0084490 A1 * 5/2004 Caputi ..... A45C 13/30 224/257
2007/0039983 A1 * 2/2007 Harrison, III ..... A45F 3/10 224/265
2008/0006661 A1 * 1/2008 Godshaw ..... A45F 3/12 224/264
2009/0032559 A1 * 2/2009 Fragale ..... A45F 5/1026 224/255
2009/0033110 A1 * 2/2009 Fragale ..... A45F 3/14 294/26
2010/0314425 A1 * 12/2010 Oldfield ..... A45C 13/30 224/264
2011/0049203 A1 * 3/2011 Stark ..... A45F 3/14 224/255
2015/0201738 A1 * 7/2015 Lourie ..... A45F 3/10 224/266

* cited by examiner

DEVICE FOR CARRYING SHOULDER BAGS

CLAIM OF PRIORITY

This application claims the benefit of U.S. Provisional Patent Ser. No. 62/808,810, filed on Feb. 21, 2019, which is incorporated by reference in its entirety.

FIELD OF THE INVENTION

The present invention relates to a device worn by a user that allows the user to carry shoulder bags in an efficient manner.

BACKGROUND

A problem when traveling via foot and via public transportation is the absence of the ability to easily and safely manage shoulder bags. Such problems include accessing the bags, keeping bag straps in place, maintaining balance of bags, increasing awareness of postural alignment and overall ease of carrying bags by the user. This act of transporting multiple shoulder bags does not take advantage of the benefits of weight distribution.

SUMMARY

The device disclosed herein is a lightweight, small, easily packable, hands-free accessory that improves how people carry shoulder bags. The device is a mechanism worn on the user's upper back that leaves the individual's hands free and enhances the ease of carrying shoulder bags, especially in an urban environment. The device can be worn on bare shoulders, clothing and outerwear. This device helps to equalize the weight distribution of shoulder bags across the top of the trapezius muscle and allows for a less cumbersome commute via foot and public transportation.

The solution described herein is directed to improve the management of carrying bags in the urban environment and in other settings. The target market is focused on, but not limited to, individuals who carry multiple bags while traveling by foot and by public transportation.

Some individuals use a wheeled bag as an alternative to wearing a backpack or carrying multiple shoulder bags in an effort to reduce stress on shoulders, neck and back. The device has advantages over a wheeled bag: it takes no extra space when walking streets or boarding public transport and it eliminates the issue of spinal torque and twist, a situation where the arm and shoulder hauling the wheeled bag tend to be pulled back from the torso, and the other arm and shoulder tend to lunge or protrude forward, thus twist or torque on the torso and spine.

BRIEF DESCRIPTION OF THE FIGURES

The accompanying figures, where like reference numerals refer to identical or functionally similar elements throughout the separate views, together with the detailed description below, are incorporated in and form part of the specification, serve to further illustrate embodiments of concepts that include the claimed invention and explain various principles and advantages of those embodiments.

Figure 1:
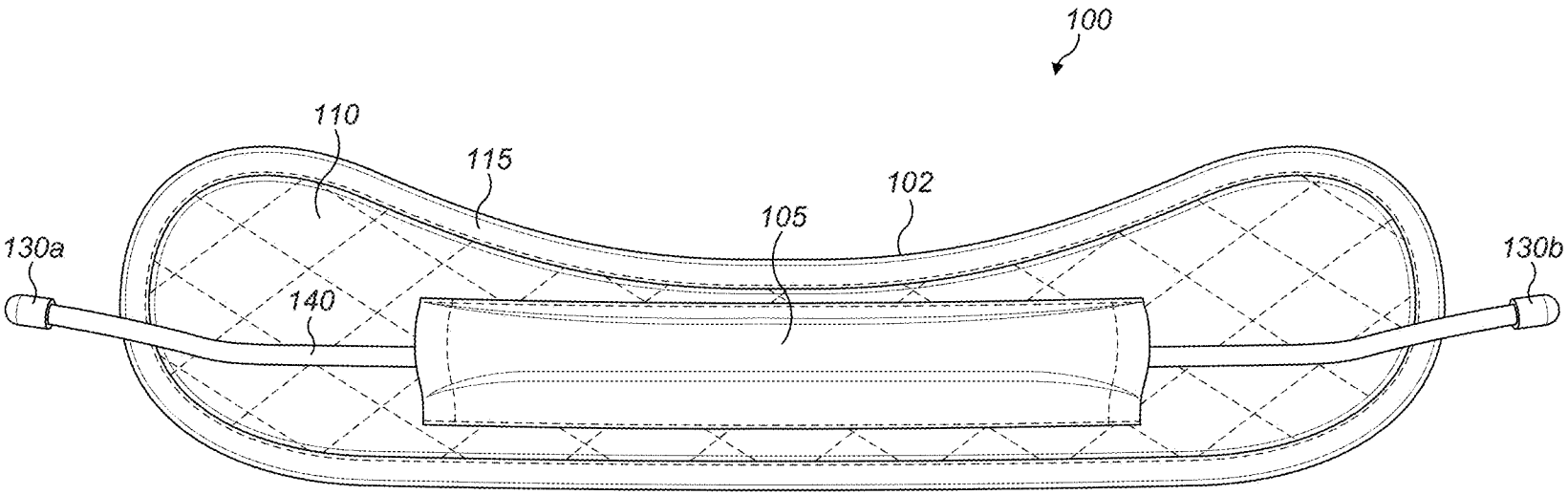
FIG. 1 shows an overhead view of the outward-facing side of the device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The device disclosed herein has two sides: (1) an outward-facing side that faces away from the user when in use; and (2) a back-facing side that rests on the upper back of the user when in use.

Turning to FIG. 1, shown is an overhead view 100 of the elongated outward-facing side of the device 102. The outward-facing base 110 of the device is generally in an elongated "kidney bean" shape and is surrounded by an outer stitching 115 that secures the outward-facing base 110 to the back-facing base (shown in FIG. 3 as 310). The outer stitching may also secure light padding in between the outward-facing base 110 to the back-facing base.

The elongated outward-facing side has a narrow center outward-facing portion with a minimum center width and has a wide left outward-facing portion and a wide right outward-facing portion each having a similar maximum peripheral width.

Attached across the length center of the outer-facing base 110 is a securing flap 105 with an inner surface (not shown) and a shown outer surface. The securing flap 105 may be attached to the outward-facing base 110 via stitching, stapling, adhesives or any other attaching means. Once attached, the securing flap 105 forms a tunnel-like channel surrounded by the outward-facing base 110 and the inner surface of the securing flap 105.

The securing mechanism 105 allows a flexible member 140 to be securely threaded through the tunnel-like channel surrounded by the outward-facing base 110 and the inner surface of the securing flap 105. The flexible member 140 may include a left endcap 130*a* and a right endcap 130*b*. The left endcap 130*a* and the right endcap 130*b* may be of any material (flexible or inflexible) and of any shape.

Figure 2:
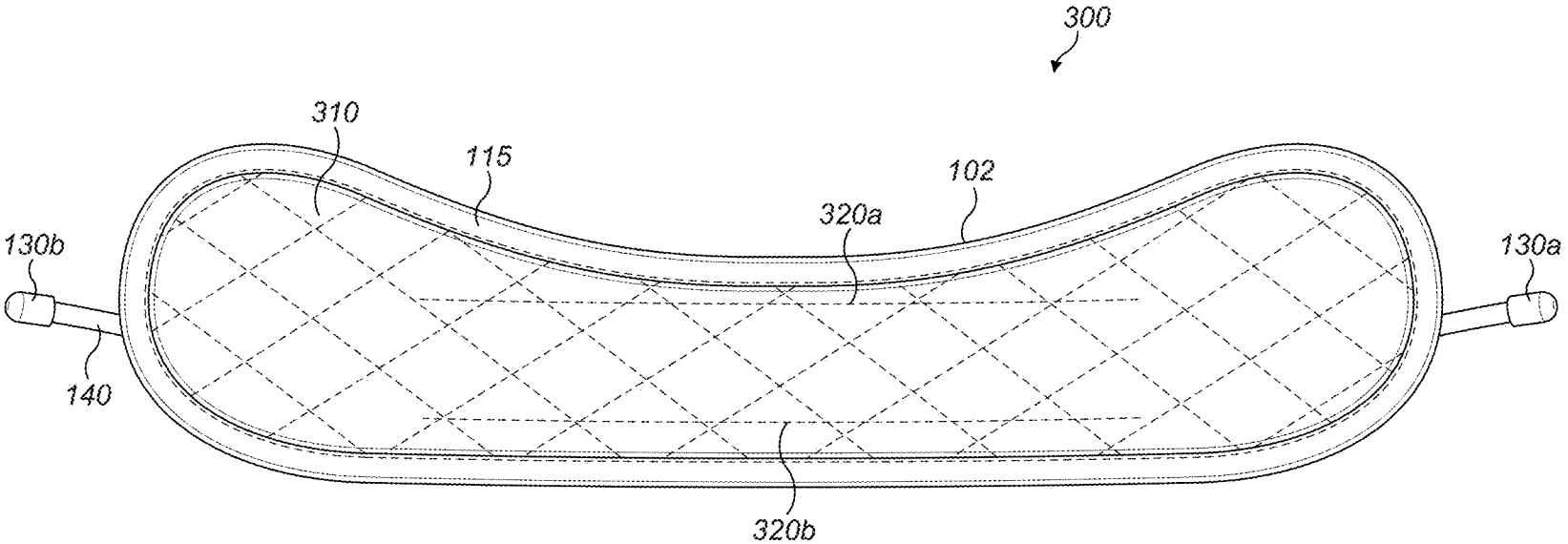
FIG. 2 shows an overhead view of the back-facing side, or underside, of the device.

Turning to FIG. 2, shown is an overhead view 300 of the elongated back-facing side of the device 102. The back-facing base 310 of the device 102 is generally in an elongated "kidney bean" shape and is surrounded by an outer stitching 115 that secures the back-facing base 310 to the outward-facing base (shown in FIG. 1 as 110) and any light padding in between them.

The elongated back-facing side has a narrow center back-facing portion with a minimum center width and has a wide left back-facing portion and a wide right back-facing portion each having a similar maximum peripheral width. The overall device 102 width varies between the minimum center width and the maximum peripheral width because the upper, neck-facing, edge of the outer stitching 115 has a concave curve and the lower, floor facing edge has a slightly convex curve. Across the length of the center of the outward-facing base 110 are stitchings 320*a*, 320*b* that secure the securing flap 105 (not shown) to the outward-facing base 110. Since the flexible member 140 is longer than the length of the device 102, the ends of the flexible member 140 and its left endcap 130*a* and right endcap 130*b* are visible in this overhead view 300.

Figure 3:
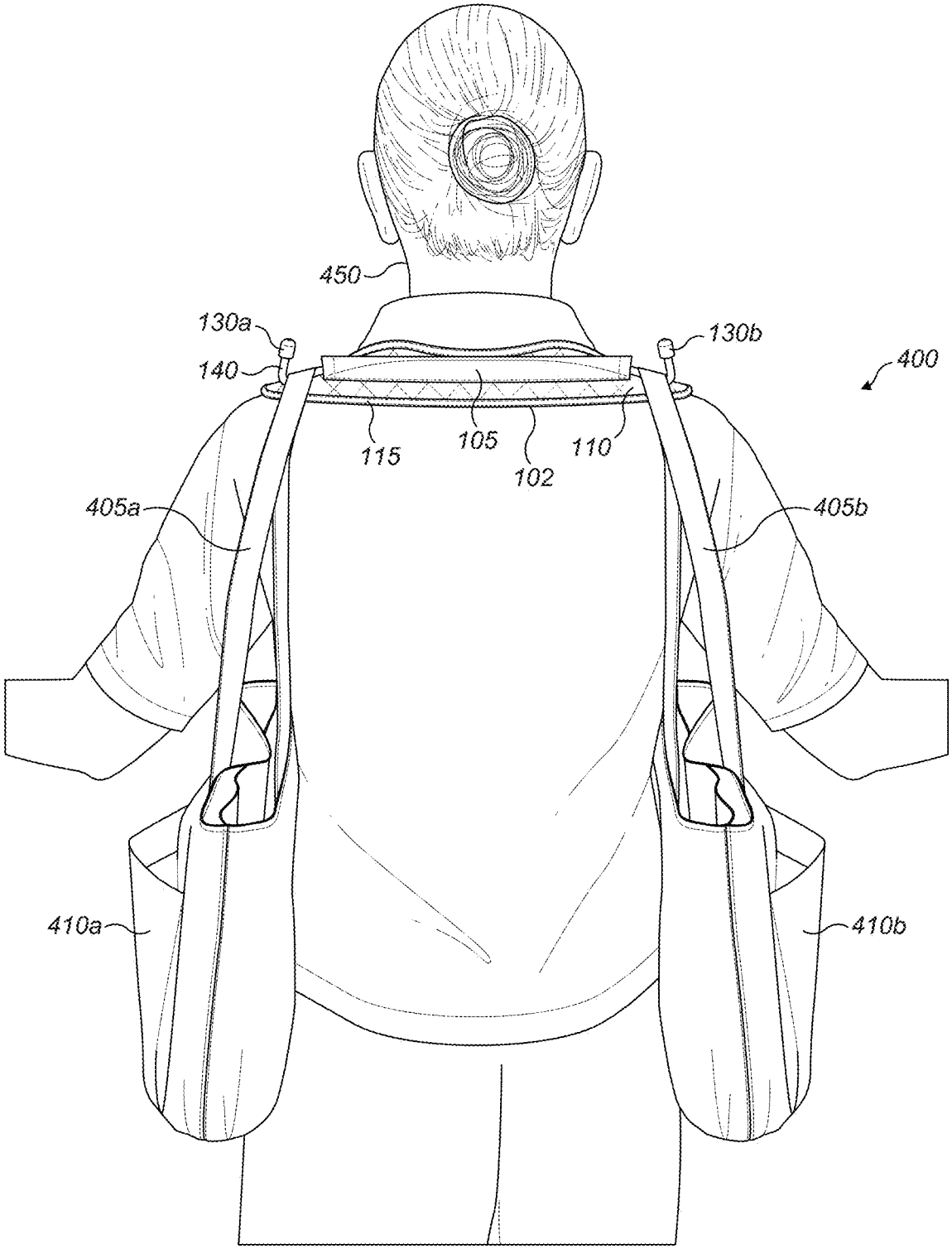
FIG. 3 shows the device in use by a user.

Turning to FIG. 3, shown is a back or posterior view 400 of the device 102 in use by a user 450. The outward-facing base 110, the outer stitching, and the securing flap 105 are visible, along with the ends of the flexible member 140 with its left endcap 130*a* and right endcap 130*b*. The back-facing base (not shown) of the device 102 generally rests bilaterally across the midpoint of each upper trapezius muscle of the user 450 between the end of shoulder and junction of neck and shoulder (upper back). The bag straps 405*a*, 405*b* rest on the respective ends of flexible member 140 that is threaded through the securing flap.

Figure 4:
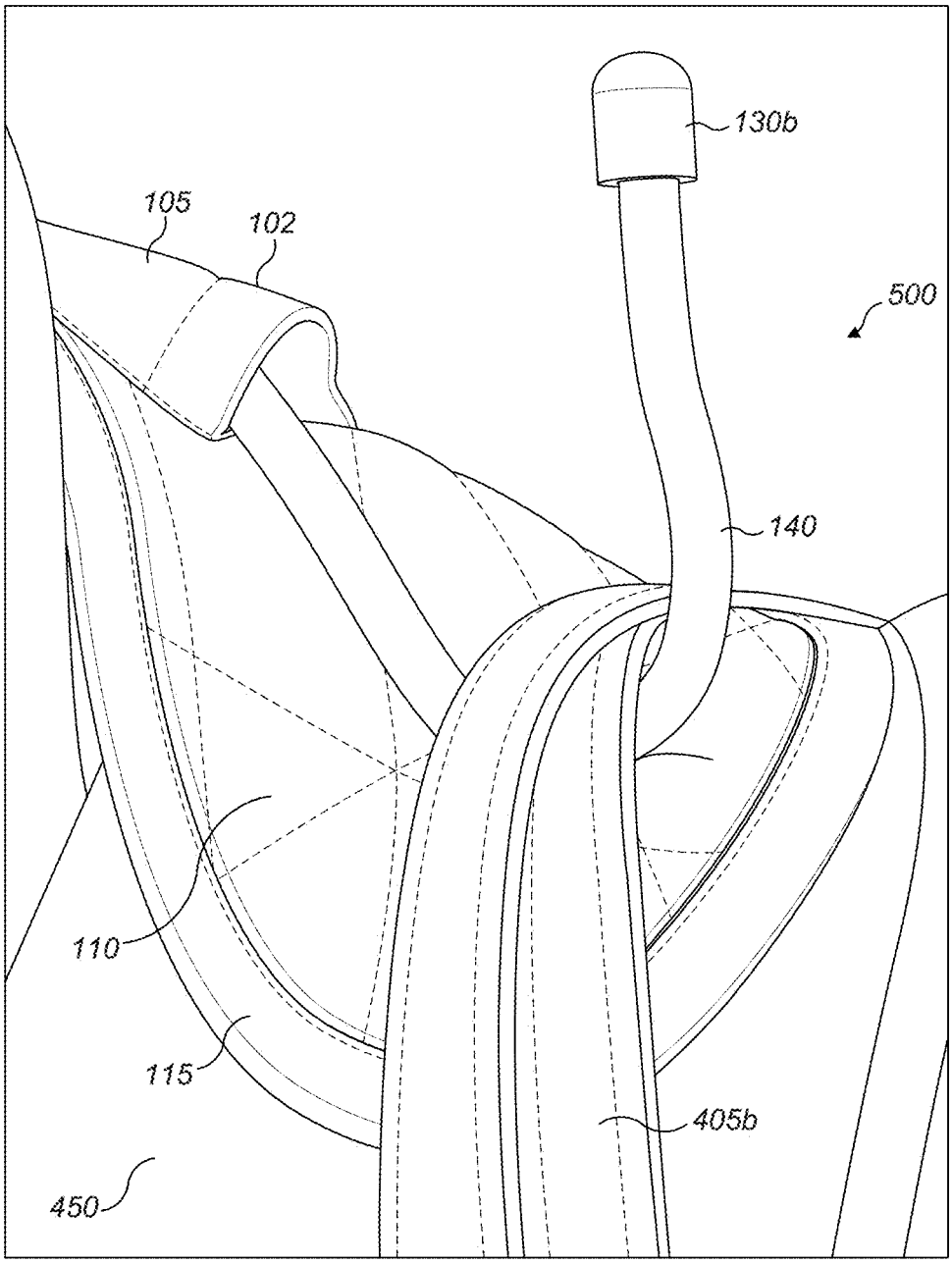
FIG. 4 is a close-up view of a portion of FIG. 3 as viewed from the front left shoulder.

FIG. 4 shows a detail view 500 of a portion of FIG. 3 showing the front or anterior aspect of the device 102 as it drapes or rests over the top of the shoulder onto the clavicle. Shown is a bag strap 405*b* resting on the left end of the flexible member 140 that is threaded through the securing flap 105 of the device 102 on a user 450. The ends of the flexible member 140 may be turned upright so that the ends of the flexible member 140 and the endcap 130*b* secure the bag straps 405*b* from sliding off the device 102. The weight carried by the strap 405*b* (which may be the shoulder bag, not shown) operates to mold the shape of the outward-facing base 110, the back-facing base (not shown) and the outer stitching 115 so that the device 102 better adheres to the upper back of the user.

The device 102 may be made of flexible materials so that it can easily be folded and stored when not in use.

The width of the midpoint of the device 102 may be about 2.5 inches and the gradual curve of the base leads to the widest part of the base that may be about 3.75 inches. Thus, the ratio of the width from the narrowest to the widest part of the device 102 may be about ⅔.

The device 102 may be produced in several versions. The base of the "standard" device 102 may measure about 15 inches long. An "elongated" device 102 may measure about 17 inches long. This 2-inch increase is in the midpoint of the base and is in length such that the width at both ends of the base remains the same. This means the ratio of the width from the narrowest to the widest part of the device 102 remains about ⅔. The ⅔ ratio is designed to better ensure that the device 102 adheres to the user 450.

The tunnel-like channel (through which the flexible member 140 runs) in the "standard" device 102 may measure about 8 inches long and 10 inches long in the "elongated" device 102. The flexible member 140 may be about 18 inches long for the "standard" device 102 and about 24 inches long for the "elongated" device 102.

The outward-facing base 110, the back-facing base 310, the outer stitching 115, and the securing flap 105 may be of a similar or different materials. Such materials may be of any fabric or textile in a smooth or quilted surface pattern and may be of durable, lightly padded materials. The materials may be of a type that includes roughness or texture that increases the friction between the back-facing side of the device 102 and the upper back of the user when in use.

The device 102 may be manufactured in a factory.

When worn by the user 450, the device 102 secures the straps 405*a*, 405*b*, distributes the weight of the bags 410*a*, 410*b* and enables hands-free movement for the user 450. (A more efficient use of the device 102 requires that a bag be carried simultaneously on each shoulder of the user 450.)

By solving the problems of imbalance, slippage and unease, the device 102 enables the user 450 to have an improved experience while carrying shoulder bags 410*a*, 410*b*. In contrast to a bulky backpack, the device 102 enables the user 450 to carry the shoulder bags 410*a*, 410*b* close to both sides of the torso (between the arms and rib cage) while taking up less space. This puts the user 450 in control of the bags 410*a*, 410*b* rather than having the restriction of accessing contents of a backpack while wearing it.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. A system comprising:

a) a left shoulder bag carried over a user's left shoulder via a left shoulder strap, and a right shoulder bag carried over a user's right left shoulder via a right shoulder strap; and b) a device worn partially over both shoulders of a user, comprising:

an elongated flexible outward-facing base having a narrow center outward-facing portion with a minimum center width, and having a wide left outward-facing portion and a wide right outward-facing portion each having a similar maximum peripheral width;

an elongated flexible back-facing base for partial placement over both shoulders of the user having a narrow center back-facing portion with the minimum center width, and having a wide left back-facing portion and a wide right back-facing portion, each having the similar maximum peripheral width;

a flexible outer stitching surrounding the outward-facing base and the back-facing base, wherein the outer stitching secures the outward-facing base to the back-facing base;

a flexible securing flap having a securing flap inner surface that is secured to the outward-facing base along at least the narrow center outward-facing portion;

a tunnel-like channel formed by the outward-facing base and the securing flap inner surface;

a flexible member threaded through the tunnel-like channel having a flexible member left side and a flexible member right side;

wherein the flexible member, when fully extended, is capable of extending beyond the wide left outward-facing portion and beyond the wide right outward-facing portion;

wherein the flexible member left side secures the left shoulder bag when the left shoulder strap is placed on the user's left shoulder; and wherein the flexible member right side secures the right shoulder bag when the right shoulder strap is placed on the user's right shoulder.

2. The system as in claim 1, wherein the flexible member has a left endcap on the flexible member left side and a right endcap on the flexible member right side.

3. The system as in claim 2, wherein the outer stitching further secures light padding.

4. The system as in claim 3, further comprising:

two lines of stitching incorporated within the elongated back-facing base at least within the narrow center back-facing portion that secures the securing flap to the outward-facing base.

5. The system as in claim 3, wherein overall device width varies between the minimum center width and the maximum peripheral width because an upper, neck-facing, edge of the outer stitching has a concave curve and a lower, floor facing edge has a slightly convex curve.

6. The system as in claim 5, wherein the ratio of the minimum center width and the maximum peripheral width is approximately ⅔.

7. The system as in claim 3, wherein the back-facing base comprises a material that increases friction between the back-facing base of the device and the user's upper back when the device is worn by the user.

8. A device comprising:

an elongated flexible outward-facing base having a narrow center outward-facing portion with a minimum center width, and having a wide left outward-facing portion and a wide right outward-facing portion each having a similar maximum peripheral width;

an elongated flexible back-facing base for wearing partially over both shoulders of a user having a narrow center back-facing portion with the minimum center width, and having a wide left back-facing portion and a wide right back-facing portion, each having the similar maximum peripheral width;

a flexible outer stitching surrounding the outward-facing base and the back-facing base, wherein the outer stitching secures the outward-facing base to the back-facing base;

a flexible securing flap having a securing flap inner surface that is secured to the outward-facing base along at least the narrow center outward-facing portion;

a tunnel-like channel formed by the outward-facing base and the securing flap inner surface;

a flexible member threaded through the tunnel-like channel;

wherein the flexible member, when fully extended, is capable of extending beyond the wide left outward-facing portion and beyond the wide right outward-facing portion; and wherein when the device is worn by a user, the flexible member is capable of: (a) securing a left shoulder bag having a left shoulder bag strap when the left shoulder bag strap is placed on the user's left shoulder; and (b) securing a right shoulder bag having a right shoulder bag strap when the right shoulder bag strap is placed on the user's right shoulder.

9. The device as in claim 8, wherein the flexible member has a left endcap and a right endcap.

10. The device as in claim 9, wherein the outer stitching further secures light padding.

11. The device as in claim 10, further comprising:

two lines of stitching incorporated within the elongated back-facing base at least within the narrow center back-facing portion that secures the securing flap to the outward-facing base.

12. The device as in claim 10, wherein overall device width varies between the minimum center width and the maximum peripheral width because an upper edge of the outer stitching has a concave curve and a lower edge has a slightly convex curve.

13. The device as in claim 11, wherein the ratio of the minimum center width and the maximum peripheral width is approximately ⅔.

14. The device as in claim 8, wherein the back-facing base comprises materials that increase friction between the back-facing base of the device and a user's upper back when the device is worn by the user.

* * * * *